United States Patent [19]

Birch

[11] Patent Number: 4,557,328

[45] Date of Patent: Dec. 10, 1985

[54] METHOD FOR UNDERGROUND BURNING OF COAL FOR ENERGY

[76] Inventor: Charles H. Birch, 836 W. Shamokin St., Trevorton, Pa. 17881

[21] Appl. No.: 606,632

[22] Filed: May 3, 1984

[51] Int. Cl.[4] ..... E21B 43/243

[52] U.S. Cl. ..... 166/256; 122/44 R; 165/45; 166/57; 166/302

[58] Field of Search ..... 166/256, 257, 258, 259, 166/260, 261, 262, 302, 57; 165/45; 122/44 R

[56] References Cited

U.S. PATENT DOCUMENTS

| | | | |
|---|---|---|---|
| 3,160,208 | 12/1964 | Jorda | 166/256 X |
| 3,274,769 | 9/1966 | Reynolds | 60/641.2 |
| 3,952,802 | 4/1976 | Terry | 166/261 X |
| 3,987,852 | 10/1976 | Terry | 166/260 X |
| 4,018,279 | 4/1977 | Reynolds et al. | 166/258 |
| 4,019,577 | 4/1977 | Fitch et al. | 165/45 X |
| 4,089,373 | 5/1978 | Reynolds et al. | 166/256 |

*Primary Examiner*—George A. Suchfield
*Attorney, Agent, or Firm*—John B. Dickman, III

[57] ABSTRACT

A method and apparatus for generating heat from in situ in ground burning of coal. The method described involves lowering a boiler connected to a water line and a steam line into burning coal region and heating the boiler to produce steam from water. The steam is useable to drive steam turbine/generator equipment or as a heat source. The apparatus for generating steam includes a boiler with a number of heat circulating tubes to quickly heat the water. The boiler is fed by a small diameter water line. Steam from the boiler is removed through a larger diameter line.

6 Claims, 1 Drawing Figure

METHOD FOR UNDERGROUND BURNING OF COAL FOR ENERGY

BACKGROUND OF THE INVENTION

The invention is directed to the field of spent coal utilization as an energy source. In particular, it is concerned with in situ burning of coal where steam is generated as a power source for driving a steam turbine generator, without bringing gaseous contaminates to the surface.

There are several patents in the field of spent coal utilization, the inventor is aware of the following:

U.S. Pat. No. 3,379,248, Apr. 23, 1968; U.S. Pat. No. 4,089,372, May 16, 1978; U.S. Pat. No. 4,089,373, May 16, 1978; U.S. Pat. No. 4,169,506, Oct. 2, 1979.

In U.S. Pat. No. 3,379,248, water is injected into a burning coal formation and steam is removed. Water is forced into the formation through inlet wells and steam is removed through an outlet well. Steam leaving the formation carries hydrocarbons and residual combustion gases to the surface where contaminates may be released.

U.S. Pat. No. 4,089,372 discloses a method for producing heat from coal, among other things. In situ burning of a coal formation generates combustible gases and coal tar mists are driven from the coal for condensation at the surface. The gases and coal tar mists are removed from the formation through a heat exchanger where part of the heat is used to convert water to steam. The steam produced is used to drive a steam turbine generator. The amount of steam produced is dependent upon the heat transfer from the removed gases and mists. This is substantially reduced because of the location of the heat exchange above the burning coal.

A closed loop steam generator is used in U.S. Pat. No. 4,089,373 to drive a steam turbine. The in-situ coal burning process involves positioning a closed loop generator in the area of burning to water converted into steam. The closed loop generator may have different forms, the one form of interest has continuous conduit which consists of a pipe which passes condensed steam from a turbine downward through a first pipe which joins a second vertical pipe. The condensed steam goes down as hot water and is heated and passes upward through the second pipe as steam.

U.S. Pat. No. 4,169,506 is directed towards a process for in-situ retorting of oil shale and energy recovery from generated off gases. A purification zone is used to remove gas impurities that would be detrimental to the environment. The purified gases are used to operate a gas turbine to produce a source of energy.

The combined effect of the above patents fall short of the present invention. A review of these patents will show that the method and apparatus of this invention is beyond the scope of any one of the patented in-situ energy source.

SUMMARY OF THE INVENTION

The present invention is directed to an in-situ system for recovering heat energy from in ground burning of coal. The method of the present invention provides a practical way of recovering such heat energy without polluting the atmosphere with gas impurities. In the specialized environment of a burning coal formation, noxious gases are given off which are harmful to the atmosphere. With the present invention, the amount of such noxious gases escaping from the coal formation is substantially reduced, which the available useable heat energy is maintained at a high BTU level. This is the only environmentally pure method of utilizing the energy from burning coal mines.

The present method for producing useable heat energy for driving a steam turbine includes a source of air for the burning coal formation. Air holes drilled into the formation provide the source of air and, if necessary, air pumps are used to circulate air in the formation. These air holes are located in the formation to provide the greatest amount of burning for the steam generation system of the invention.

Another critical element of the method for utilizing in-situ burning of coal is to locate a steam boiler at the greatest source of heat. By drilling a hole for lowering water and steam pipes into the formation with the air holes surrounding it, the air forced into the formation will direct the burning toward the water and steam pipes. The boiler is at the lowest end of the water and steam pipe for greatest efficiency.

The steam generator of the invention circulates water from the surface into the steam boiler where it is converted to steam and lifted to a steam turbine on the surface. The boiler is a large container with a small water inlet pipe and a large steam pipe. For efficient conversion of water to steam, the container has a number of heat circulating conduits.

DESCRIPTION OF THE INVENTION

Figure 1:
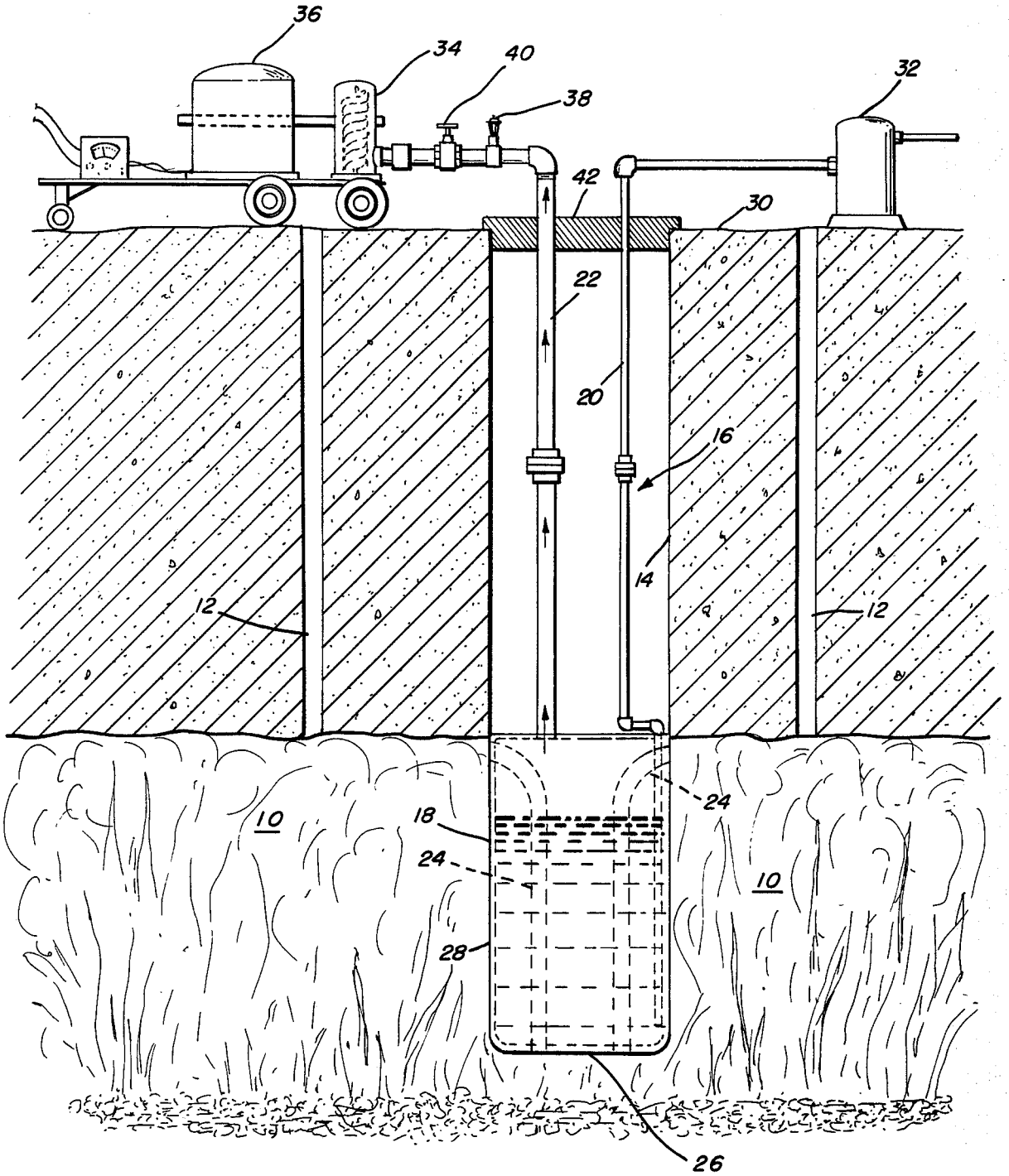
FIG. 1 is a plan view of a steam generating system of the invention showing the in-situ burning of coal and the conversion of water to steam.

Referring to the drawing, there is shown a burning coal formation 10 and air holes 12. A large bore hole 14 is drilled between the air holes 12, such that the air directed through the air holes focuses the heat from the burning coal below the large hole 14. Even though it is not shown, the air holes 12 surround the hole 14 and there may be air pumps to force air into the formation.

A steam generator apparatus 16 is lowered into the coal formation through hole 14 where it is positioned slightly above the burning coal to receive the greatest amount of heat. The steam generator 16 has a boiler 18, inlet water line 20, and outlet steam line 22. The boiler 18 is a container with a number of heat conduits 24 extending from the bottom 26 to near the top of the cylindrical wall 28. The boiler is heated by the heat from the burning formation circulating around the cylindrical wall 28 and through the heat conduits 24, entering the conduits at the bottom 26 of the boiler.

Water is fed from the surface 30 by a feed tank and pump 32 downward through water line 20. The water empties into the bottom of the boiler 18 where the water line 20 ends, in the manner the coolest water is heated the most by exposure to the burning coal. As the water is heated, it is converted to steam to the point at the top of the boiler 18 only super heated steam leaves through steam outlet line 22.

Steam lifted to the surface 30 through steam line 22 is used to drive a steam turbine 34, which in turn drives a generator 36. The generator 36 may be used for any number of purposes, such as to produce electricity. For safety reasons, the steam line 22 has a pressure relief valve 38 and a pressure gauge 40.

In order to prevent unwanted noxious gases from escaping from the burning coal formation 10, the hole 14 has a cap 42 which surrounds the inlet water line 20 and the outlet steam line 22.

Since most in situ burning coal formations burn out, the steam turbine generator system may be mounted on a flat bed trailer for transporting the next formation. The associated drilling equipment and other trailers for transporting the boiler and water and steam line would be kept closeby.

While only one form of the invention has been described, it is understood that one skilled in the art may modify the invention. However, one should consider the invention in view of the drawing and specification taken with the claims.

I claim:

1. A method for recovering the heat from in situ burning of coal formations as a source of energy comprising;

a. providing at least one air hole as a source of directed air to aid in burning the coal formation;

b. drilling a hole for lowering a water to steam generating system into the burning coal formation;

c. lowering a water to steam generating system into the burning coal formation, where the drilled hole has been positioned to receive the greatest amount of heat;

d. circulating water into the water to steam generating system and removing steam as a source of energy;

e. said source of directed air directing the heat from the burning formation towards said drilled hole for the greatest heat concentration;

f. capping said drilled hole to prevent gases from escaping at the surface; and g. providing said water to steam generating system with an inlet water line and outlet steam line that is sealed to prevent any communication with the gases in the burning formation.

2. A method as in claim 1 where the water entering the water to steam generating system is exposed to heat conduits for efficient conversion to steam.

3. A method as in claim 2 where the water inlet line is smaller than the steam outlet line to provide for efficient conversion to steam.

4. A method as in claim 3 where the water to steam generator system is provided with a boiler, placed at the place in the drilled hole for receiving the greatest amount of heat.

5. A method as in claim 4 where the water inlet line empties into bottom of the boiler for efficient conversion of water to steam.

6. A method as in claim 5 wherein the boiler has a plurality of heat conduits extending through the boiler for efficient conversion of water to steam.

* * * * *